US011402765B2

(12) United States Patent
Pettingill et al.

(10) Patent No.: US 11,402,765 B2
(45) Date of Patent: Aug. 2, 2022

(54) PRINT MATERIAL CONTAINER

(71) Applicant: Hewlett-Packard Development Company, L.P., Spring, TX (US)

(72) Inventors: Justin Pettingill, Boise, ID (US); Sean Daniel Fitzgerald, Boise, ID (US); Gabriel S McDaniel, Boise, ID (US); Jeffrey H Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/297,502

(22) PCT Filed: Jul. 15, 2019

(86) PCT No.: PCT/US2019/041832

§ 371 (c)(1),
(2) Date: May 27, 2021

(87) PCT Pub. No.: WO2021/010968

PCT Pub. Date: Jan. 21, 2021

(65) Prior Publication Data

US 2022/0035268 A1 Feb. 3, 2022

(51) Int. Cl.
*G03G 15/08* (2006.01)

(52) U.S. Cl.
CPC ..... *G03G 15/0863* (2013.01)

(58) Field of Classification Search
CPC . G03G 15/0863; G03G 15/0865; G03G 21/12
See application file for complete search history.

(56) References Cited

U.S. PATENT DOCUMENTS

| | | | | |
|---|---|---|---|---|
| 5,508,794 | A | 4/1996 | Ikesue et al. | |
| 6,904,249 | B2 | 6/2005 | Kato et al. | |
| 8,185,034 | B2 | 5/2012 | Akaike | |
| 8,401,434 | B2 | 3/2013 | Akaike | |
| 9,341,981 | B2 | 5/2016 | Swantner et al. | |
| 9,360,797 | B1 | 6/2016 | Bayubay et al. | |
| 9,678,469 | B2 | 6/2017 | Shima | |
| 2001/0001025 | A1 | 5/2001 | Nakajima | |
| 2003/0210289 | A1 | 11/2003 | Yoshiyama et al. | |
| 2012/0039622 | A1* | 2/2012 | Cho | G03G 21/1885 399/90 |
| 2016/0062271 | A1 | 3/2016 | Leemhuis et al. | |
| 2017/0357183 | A1* | 12/2017 | Murashima | G03G 15/0865 |

FOREIGN PATENT DOCUMENTS

| | | | |
|---|---|---|---|
| JP | 2008-261968 | A | 10/2008 |
| JP | 2009-271276 | A | 11/2009 |
| JP | 5062015 | B2 | 10/2012 |
| JP | 2017-156668 | A | 9/2017 |

* cited by examiner

*Primary Examiner* — Sandra Brase
(74) *Attorney, Agent, or Firm* — Jefferson IP Law, LLP

(57) ABSTRACT

A print material container comprising a body, a transfer mechanism, an inner connector, and an outer connecter. The transfer mechanism is to move print material in or out of the body. The inner connecter is on a connecting side of the body, and is to couple to a first location of an image forming apparatus to provide print material to the image forming apparatus. The outer connecter is on the connecting side of the body, and is to couple to a second location of the image forming apparatus to collect or receive unutilized print material transferred or received from the image forming apparatus.

13 Claims, 8 Drawing Sheets

PRINT MATERIAL CONTAINER

BACKGROUND

An image forming apparatus is an apparatus for forming an image on a recording medium or in a space according to an input signal. Representative examples of the apparatus include a printer, a copy machine, a facsimile, a multifunction peripheral (MFP) that integrally implements these functions, a 3D printer, a Biologic printer, an Ink or liquid solution printer, a piezo-electric printer, a pressurized printer, a vacuum printer, a disbursement printer, and derivatives thereof that form images or objects.

One example of an image forming apparatus is a solution that uses an electro-photographic image forming apparatus using an electro-photographic method that forms a visible image utilizing particulates and/or polymers such as toner on a photoconductor by supplying toner to an electrostatic latent image formed on the photoconductor, transfers the toner image by using an intermediate transfer medium, a direct transfer medium, or a chasm-crossing attraction-based transfer medium, and then fixes the transferred toner image on a recording medium.

In other words, the image forming apparatus uses print materials, such as toner, to print an image on the recording medium. As the print material is used in image forming operations, the print material is used up after a certain time period.

DETAILED DESCRIPTION

Figure 1:
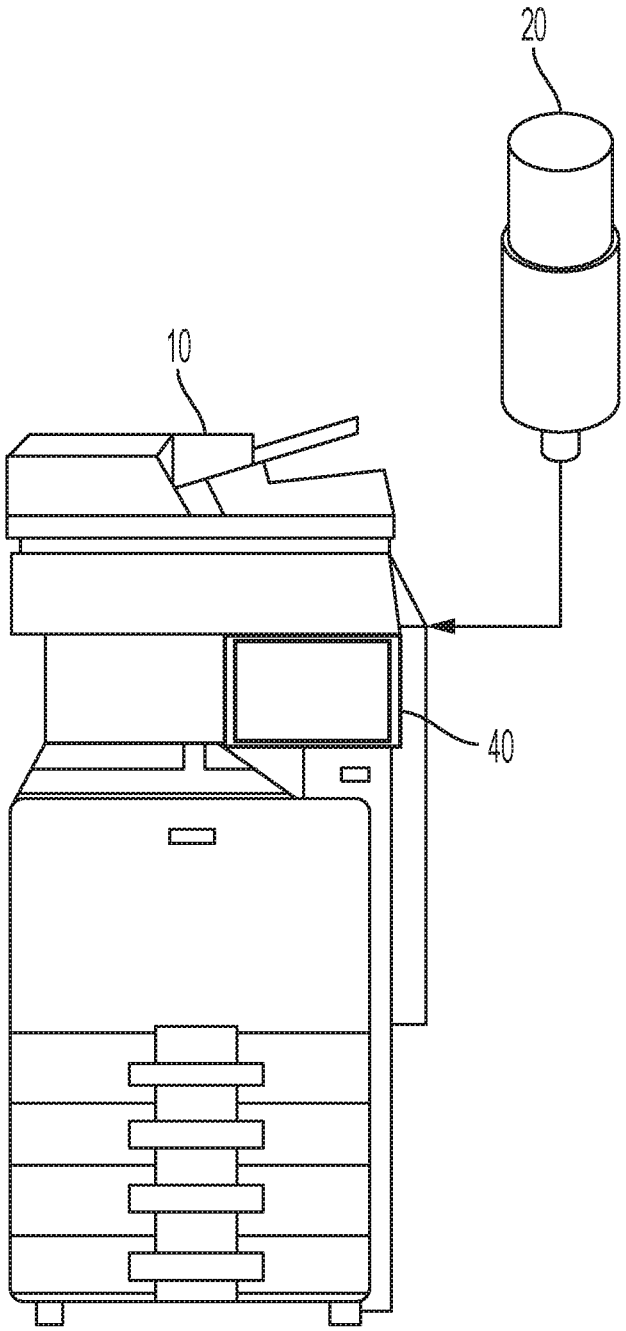
FIG. 1 is a side view of a print material container to be coupled to an image forming apparatus or intermediary apparatus providing transfer of print material to the image forming apparatus, according to an example.

Various examples of the disclosure will now be described in greater detail with reference to the accompanying drawings, wherein like reference characters denote like elements. Examples to be explained in the following may be modified and implemented in various different forms.

When it is stated in the disclosure that one element is "connected to" or "coupled to" another element, the expression encompasses not only an example of a direct connection or direct coupling, but also a connection with another element interposed therebetween. Further, when it is stated herein that one element "includes" another element, unless otherwise stated explicitly, it means that yet another element may be further included rather than being excluded.

As used herein, including in the claims, the word "or" is used in an inclusive manner. For example, "A or B" means any of the following: "A" alone, "B" alone, or both "A" and "B".

An "image forming apparatus" refers to a device for printing print data generated from an external source such as from a central or independent computing-function device or mobile device (such as a smartphone) or memory containing devices (such as a "thumb-drive") via an electrical or data connection on a recoding medium. The recording medium may include, for example, paper such as glossy paper, plain paper, art paper, overhead projector film, cardstock, a personal or industrial application such as onto or within a space or region of space, or onto a host solution delivering chemical processes to support the printed material in biologic application, and the like. Examples of the image forming apparatus described above may include a copier, a printer, a facsimile, a multi-function printer (MFP) of complexly implementing functions thereof through a single device, a 3D printer, a Biologic printer, an Ink or liquid solution printer, a piezo-electric printer, a pressurized printer, a vacuum printer, a disbursement printer, and derivatives thereof that form images or objects. The image forming apparatus may mean all devices capable of performing an image forming task, such as the printer, the scanner, the fax machine, the multi-function printer (MFP), or a display.

FIG. 1 shows a view of a print material container 20 that may be coupled to a first location of a main body of the image forming apparatus 10 to supply print material. As an image forming operation is performed in the image forming apparatus 10, the print material in the print material container at a location to supply print material is used. When the amount of print material in the print material container 20 is below a threshold, the print material container 20 may be removed from the first location and coupled to a second location of a main body of the image forming apparatus 10 to collect at least one of unutilized print material or other matter.

The image forming apparatus 10 may include a user interface 40.

Figure 2:
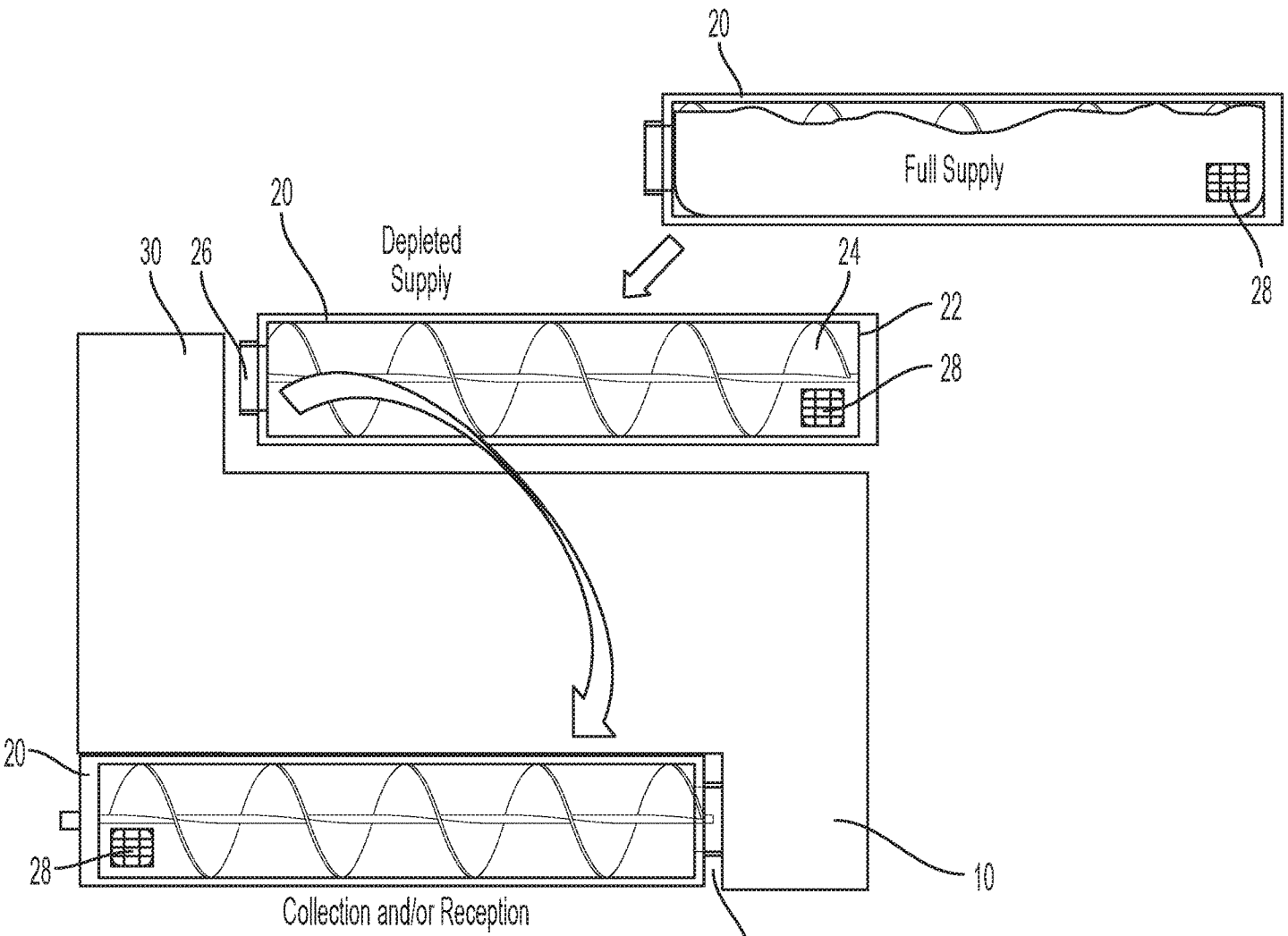
FIG. 2 is a view of a print material container being coupled to an image forming apparatus or intermediary apparatus providing transfer of print material to the image forming apparatus, according to an example.

FIG. 2 shows a view of a print material container 20 that is to be coupled to the image forming apparatus 10. The print material container 20 includes a body 22 and a transfer mechanism 24. The body 22 is to house print material. The body may house at least one of unutilized print material, waste print material, or other matter. The transfer mechanism 24 is to move the print material either in to the body 22 of the print material container or is to move print material to outside the body 22.

As an example, the transfer mechanism 24 may include an auger or turbine, or other mechanical or pressure producing or reducing feature that works to apply power to move print material or print-process waste material in or out of to help move print material in and out of the body 22 of the print material container 20. The transfer mechanism 24 may have a helical shape to help move print material in and out of the body 22 of the print material container 20. The transfer mechanism 24 may also be other shapes and devices as well, such as a pushing device, to help move print material in and out of the body 22 of the print material container 20.

A connecting side 26 of the print material container 20 is to couple to a first location 30 of the image forming apparatus 10 to supply to-be-used print material to the image forming apparatus. The to-be-used print material may be unused, previously used, recycled, or any other type of print material that is intended to be used by the image forming apparatus. The first location 30 is the print material supply location of the image forming apparatus 10. The connecting side 26 of the print material container 20 is also to couple to a second location 32 of the image forming apparatus to collect at least one of unutilized print material or other matter from the image forming apparatus 10. The second location 32 is to be used for collecting at least one of unutilized print material or other matter The print material container 20 is to couple to the second location 32 when the print material in the print material container 20 is at or below a first predetermined threshold. An example of the first predetermined threshold may be when the print material level is below 10%. Other examples of a first predetermined threshold may be 15%, 5%, 1%, or 0%.

Thus, the print material container 20 is capable of both supplying print material to the image forming apparatus 10, and once the print material level of the print material container 20 falls below a first predetermined threshold, the print material container is then capable of collecting at least one of unutilized print material or other matter from the image forming apparatus 10. Since the print material container 20 is able to first supply print material and then collect at least one of unutilized print material or other matter, the use of the print material container 20 may be extended before discarding the print material container. This extended use of the print material container may then reduce waste.

The print material container 20 may include a memory device or smart chip 28 that includes information that provides the print device with information regarding the contents of the Print Supply Container to include but not limited to the type, composition, mass, volume, estimated number of 'pages' that may be produced given a predetermined calculation or standard (such as ISO Standard 19750) or other quantity of resulting print output quantity, and many other information or data parameters for security and authentication of a print material or print supply container, that is to be used as a supply or resupply solution to a printing device. Once the image forming apparatus determines the amount of print material used from the print material container 20 is below a first predetermined threshold, the image forming apparatus may write into the memory device or smart chip 28 information to indicate that the print material container 20 is now to be used to collect at least one of unutilized print material or other matter. The image forming apparatus 10 may then inform a user, using the user interface 40 or via other electronic communication means, to indicate or inform a user or other process of the necessity to disconnect and move the print material container 20 from the input function to the location of output function of waste materials. Once the print material container 20 is coupled to the image forming apparatus 10 at the second location 32 to collect at least one of unutilized print material or other matter the image forming apparatus 10 will read the memory device or smart chip 28 to determine the print material container 20 coupled to the image forming apparatus 10 at the second location 32 is to be used for collecting at least one of unutilized print material or other matter. The image forming apparatus 10 may then inform a user using the user interface 40 to change the location of the print material container 20 from the first location 30 to the second location 32 to collect at least one of unutilized print material or other matter.

As an example, the information in the memory device or smart chip 28 to indicate the status of the print material container 20 is to supply print material may be a 1 or a 0. Then, the information in the memory device or smart chip 28 to indicate the status of the print material container 20 is to collect at least one of unutilized print material or other matter may be a 0 or a 1, respectively, as the information in the memory device or smart chip 28 to indicate the status of the print material container 20 is to collect waste may be opposite of the information in the memory device or smart chip 28 to indicate the status of the print material container 20 is to supply print material. The memory device or smart chip 28 may also use other ways to indicate the status of the print material container 20.

Once the image forming apparatus determines the amount of at least one of unutilized print material or other matter collected by the print material container 20 at the second location 32 is above a second predetermined threshold, the image forming apparatus may write into the memory device or smart chip 28 that the print material container 20 is to be removed for recycling or discarding. The image forming apparatus 10 may then inform a user using the user interface 40 to remove the print material container 20 from the second location 32 and discard the print material container 20.

An example of the second predetermined threshold may be when the print material level is above 90%. Other examples of the second predetermined threshold may be 85%, 95%, 99%, or 100%.

The image forming apparatus 10 may determine the amount of print material that remains in the print material container 20 based on a number of pages printed while the print material container 20 is coupled to the image forming apparatus 10 at the first location 30. The image forming apparatus 10 may also determine the amount of at least one of unutilized print material or other matter remains in the print material container based on a number of pages printed while the print material container 20 is coupled to the image forming apparatus 10 at the second location and how much print material remained in the print material container 20 when it was coupled to the second location 32.

Figure 3:
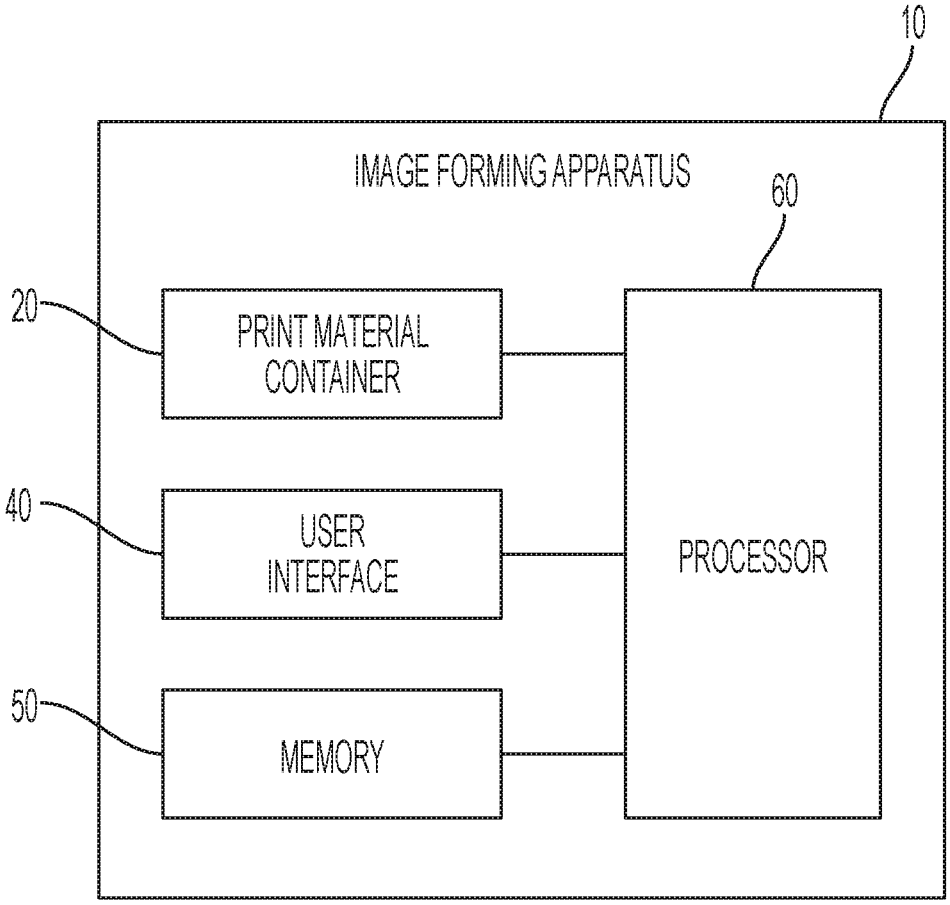
FIG. 3 is a block diagram of a configuration of an image forming apparatus, according to an example.

FIG. 3 is a block diagram of a configuration of the image forming apparatus 10, according to an example.

The image forming apparatus 10 shown in FIG. 3 may include a print material container 20, the user interface 40, a memory 50, and a processor 60. However, not all the components shown in FIG. 3 are necessary components. The image forming apparatus 10 may be embodied by using less or more components than the components shown in the drawings. The image forming apparatus 10 includes the print material container 20 when the print material container is coupled to either the first location 30 or the second location 32. Hereinafter, the components will be described.

The processor 60 may control all operations of the image forming apparatus 10 and include at least one processor like a central processing unit (CPU). The processor 60 may control other components in the image forming apparatus 10 to perform operations corresponding to the user input received through the user interface 40. The processor 60 may include at least one specialized processor corresponding to functions or an all-in-one type processor.

Figure 4A:
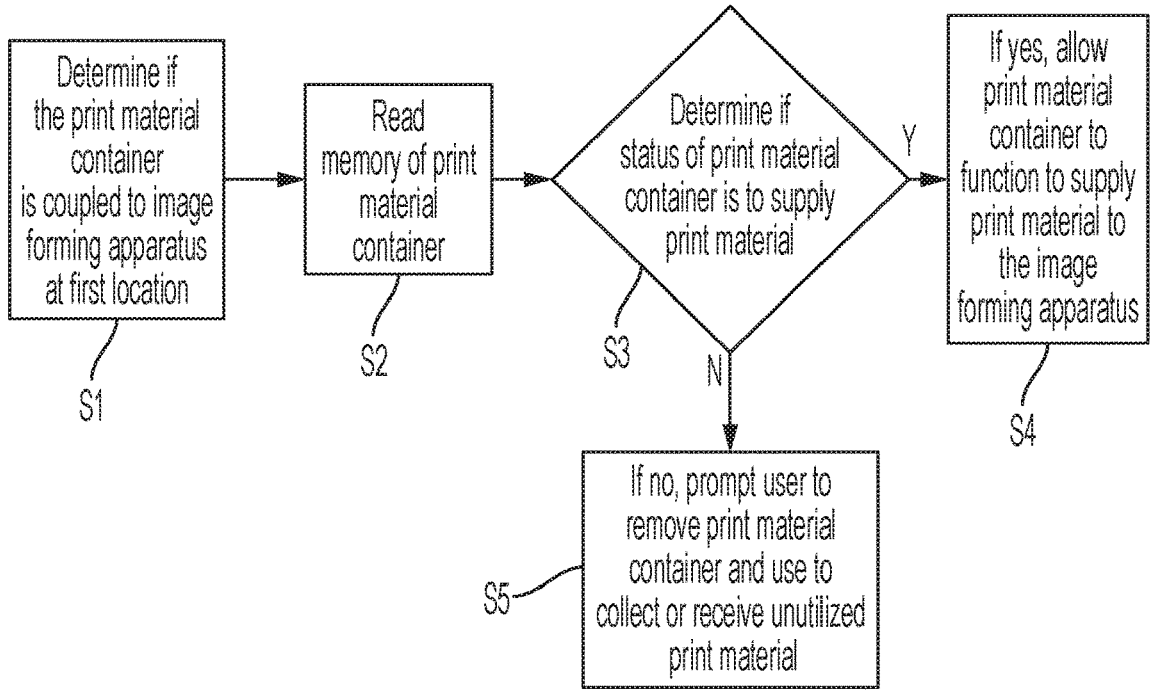
FIG. 4A is operational logic of a commonly existing or known image forming apparatus when the print material container is coupled to a supply location, according to an example.
Figure 4B:
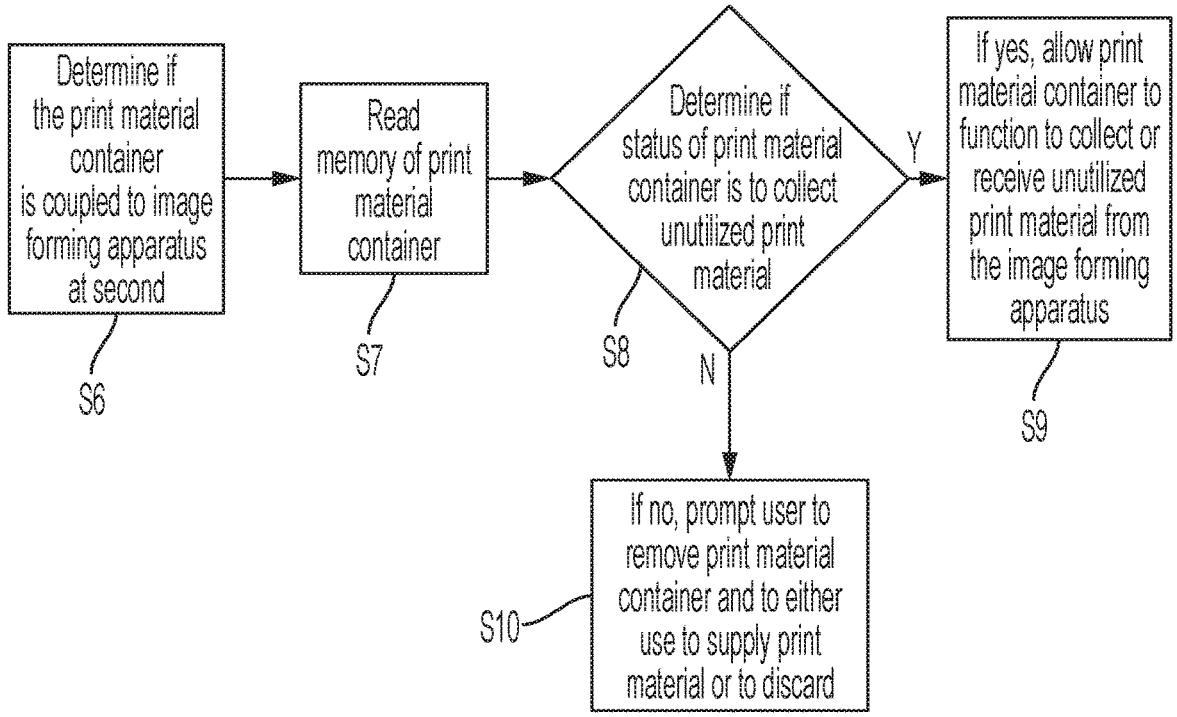
FIG. 4B is logic of the image forming apparatus when the print material container is coupled to a print solution/device that produces and transfers waste materials and other unused byproducts of a print process, according to an example.

FIGS. 4A and 4B show an example of operational logic that may be used by the image forming apparatus 10 when the print material container is coupled to the first location 30 or to the second location 32. At S1, the image forming apparatus 10 determines the print material container 20 is coupled to first location 30. At S2, the image forming apparatus 10 reads the memory device or smart chip 28 of the print material container 20. At S3, the image forming apparatus 10 determines if the status of print material container 20 is to supply print material. At S4, if the memory device or smart chip 28 includes information indicating that the print material container 20 is to supply print material, the print material container 20 is allowed to function to supply print material to the image forming apparatus 10. At S5, if the memory device or smart chip 28 does not include information indicating that the print material container 20 is to supply print material, the image forming apparatus 10 may prompt a user, using the user interface 40, to remove the print material container 20 and to use the print material container 20 to collect at least one of unutilized print material or other matter.

At S6, the image forming apparatus 10 determines the print material container 20 is coupled to second location 32. At S7, the image forming apparatus 10 reads the memory device or smart chip 28 of the print material container 20. At S8, the image forming apparatus 10 determines if the print material container 20 is set to collect at least one of unutilized print material or other matter. At S9, if the memory device or smart chip 28 includes information indicating that the status of the print material container 20 is to collect at least one of unutilized print material or other matter, the print material container 20 is allowed to function to collect at least one of unutilized print material or other matter from the image forming apparatus 10. At S10, if the memory device or smart chip 28 does not include information indicating that the print material container 20 is to collect at least one of unutilized print material or other matter, the image forming apparatus 10 may prompt a user, using the user interface 40, to remove the print material container 20 and to either discard the print material container 20 or use the print material container 20 to supply print material.

The operational logic may help notify a user if the print material container 20 is coupled to an incorrect location and needs to be removed or notify a user that the print material container 20 is coupled to the correct location. The image forming apparatus 20 may inform a user though displaying information on the user interface 40.

Figure 5A:
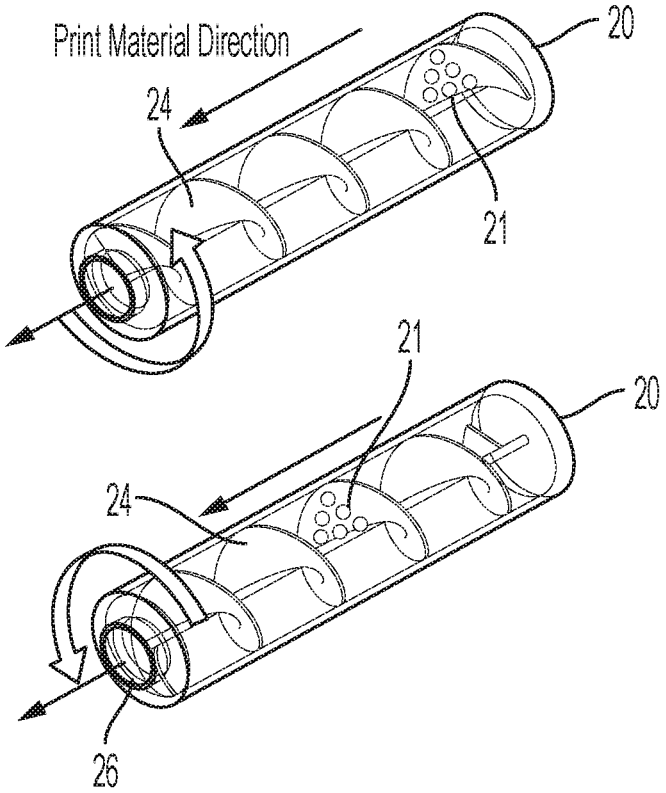
FIG. 5A-5B are perspective views of the print material container, according to an example.
Figure 5B:
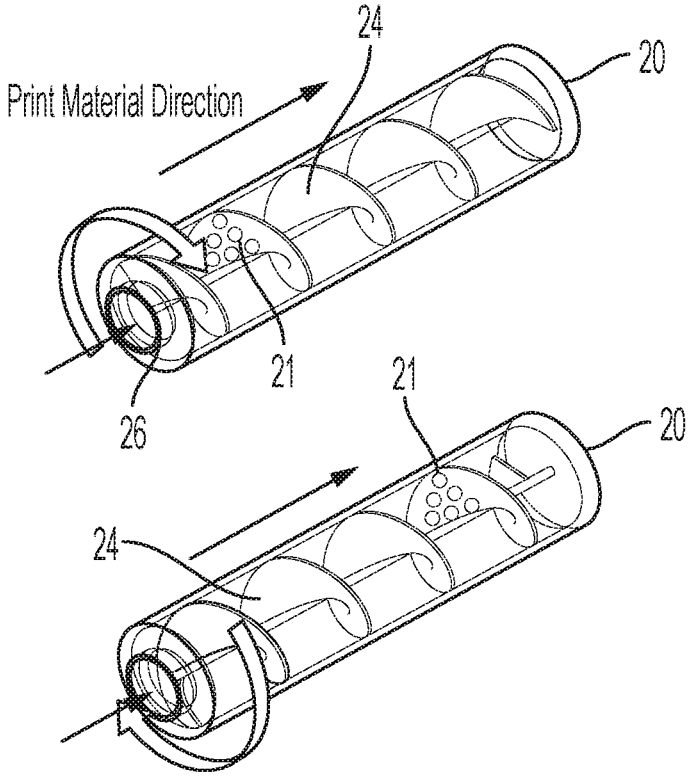

FIGS. 5A and 5B show an example of the transfer mechanism 24 shaped as an auger. The transfer mechanism 24 may be rotated in first direction, as shown in FIG. 5A to move print material 21 from inside the print material container 20 to outside the print material container 20. The transfer mechanism 24 may be rotated in a second direction, which is opposite of the first direction, as shown in FIG. 5B to move print material 21 from outside the print material container 20 to inside the print material container 20.

The print material container 20 generally rotates the transfer mechanism 24 in the first direction, as shown in FIG. 5A, when the print material container 20 is coupled to the first location 30 to move print material 21 from the print material container 20 to the image forming apparatus 10. Rotating the transfer mechanism 24 in the first direction generally moves print material 21 located inside the print material container 20 toward the connecting side 26 of the print material container 20.

The print material container 20 generally rotates the transfer mechanism 24 in the second direction, as shown in FIG. 5B, when the print material container 20 is coupled to the second location 30 to move print material 21 from the image forming apparatus 10 into the print material container 20. Rotating the transfer mechanism 24 in the second direction generally moves print material 21 located inside the print material container 20 away from the connecting side 26 of the print material container 20. The print material moved from the image forming apparatus 10 to the print material container 20 is generally at least one of unutilized print material or other matter.

Figure 6A:
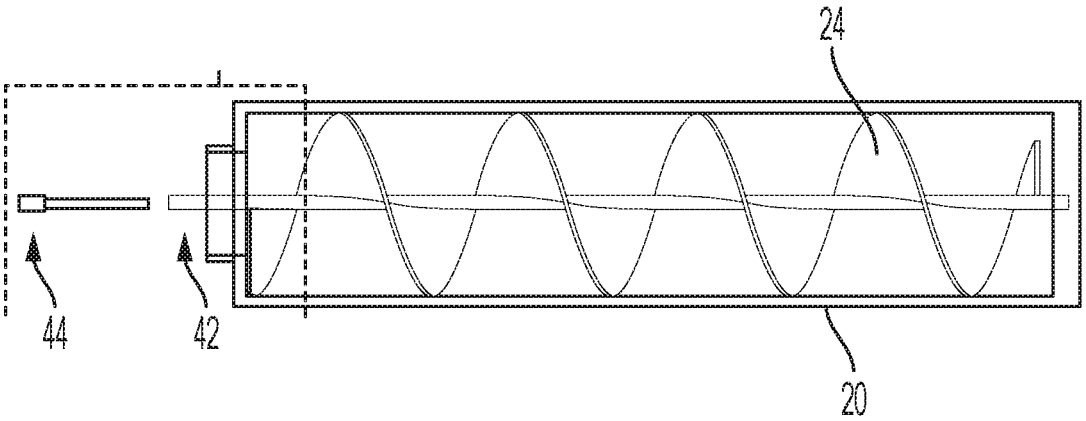
FIGS. 6A-6B are side views of the print material container, according to an example.
Figure 6B:
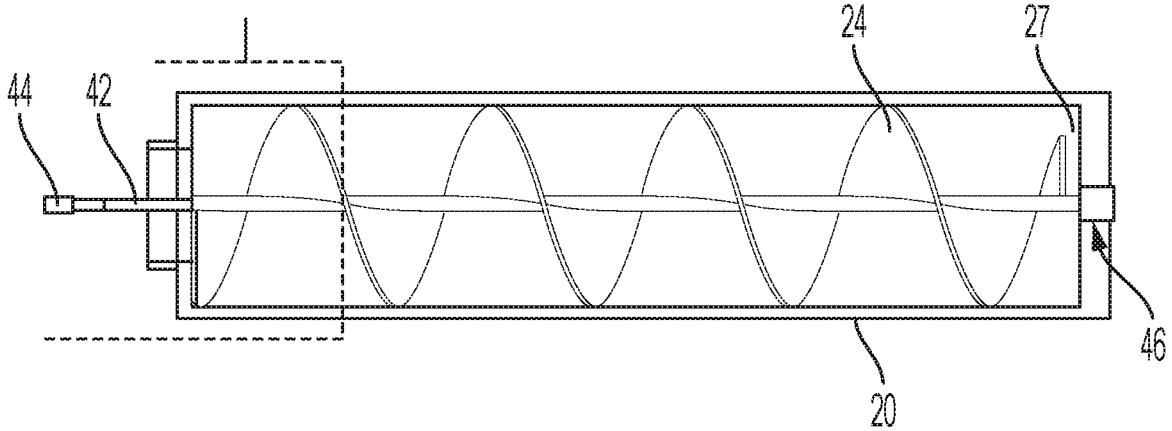

FIGS. 6A and 6B show a side view of the print material container 20. The transfer mechanism 24 may include a cartridge coupler 42 located at the end of the transfer mechanism on the connecting side 26 of the print material container 20. The imaging unit may include an imaging drive 44 to couple with a cartridge coupler 42. The imaging drive 44 may be rotated to rotate the cartridge coupler 42 which rotates the transfer mechanism 24 to move print material in or out of the print material container 20. The print material container 20 may include a spring 46 to help keep the imaging drive 44 and the cartridge coupler 42 secure when they are being rotated. The spring 46 may located at a base side 27 of the print material container, which is opposite of the connecting side 26 of the print material container 20.

Figure 7:
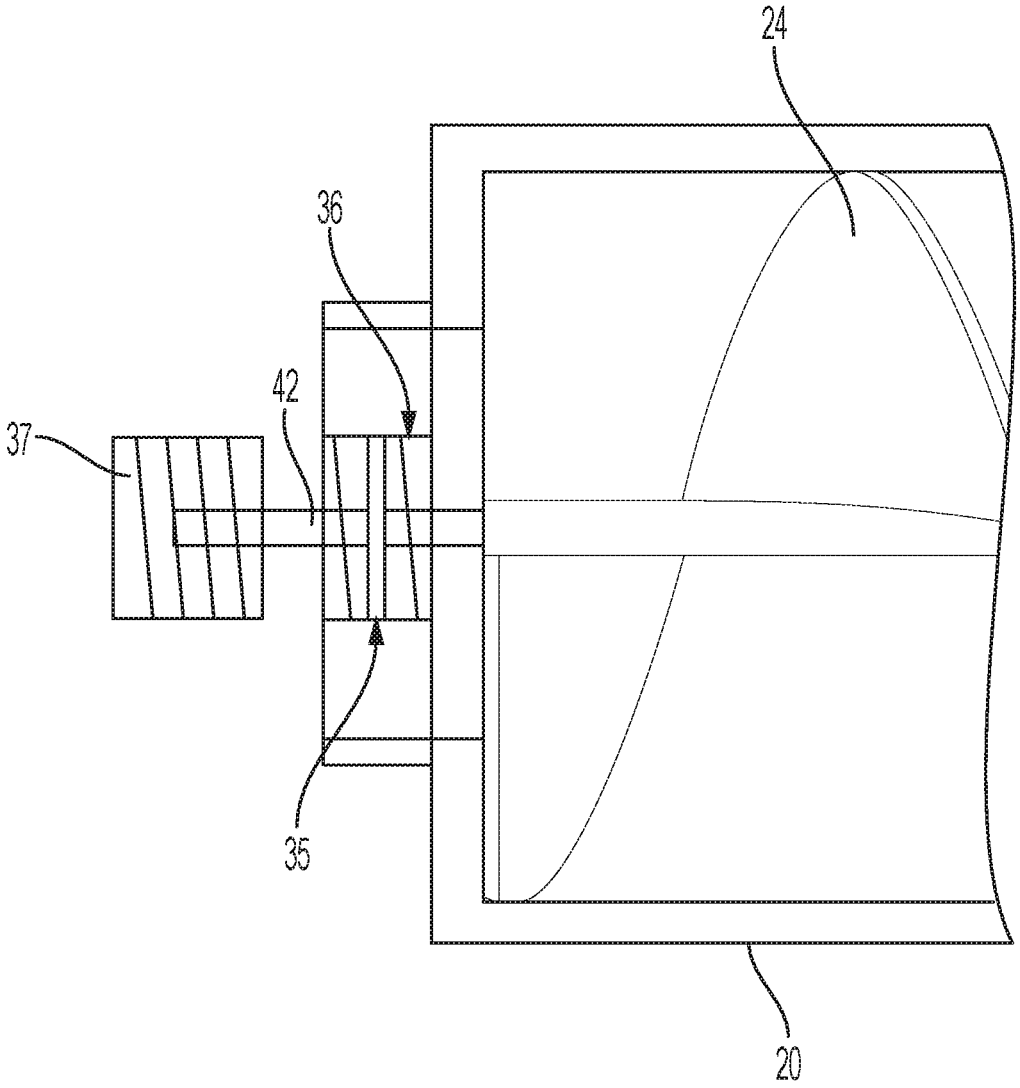
FIG. 7 is a zoomed in side view of the connecting portion or location of the print process material(s) supply container of the print material container, according to an example.

FIG. 7 shows a zoomed in side view of the connecting side 26 of the print material container 20. The print material container 20 may include an inner connector 36. The inner connector 36 may be located on the connecting side 26 of the print material container 20. The imaging forming apparatus 10 may include an image forming apparatus first connector 37. The inner connector 36 is to match with the image forming apparatus first connector 37, as the inner connector 36 is to couple with the image forming apparatus first connector 37 to install the print material container 20 at the first location 30 of the image forming apparatus. The print material container 20 may also include an inner connector O-ring 35 to seal the image forming apparatus first connector 37 and the inner connector 36 together. Sealing the image forming apparatus first connector 37 and the inner connector 36 may help prevent print material leakage and help prevent other particles from entering the print material container 20.

As an example, the inner connector 36 may include a component to couple with a first connector 37 at the first location 30 of the image forming apparatus 10. The inner connector 36 may include threads and the image forming apparatus first connector 37 may include embedder threads to mate with threads of the inner connector 36 to couple the inner connector 36 with the image forming apparatus first connector 37. The inner connector 36 and the image forming apparatus first connector 37 may also be coupled to each other using other types of connections such as a slide and lock connection, a cam lock connection, or other types of connections.

Figure 8:
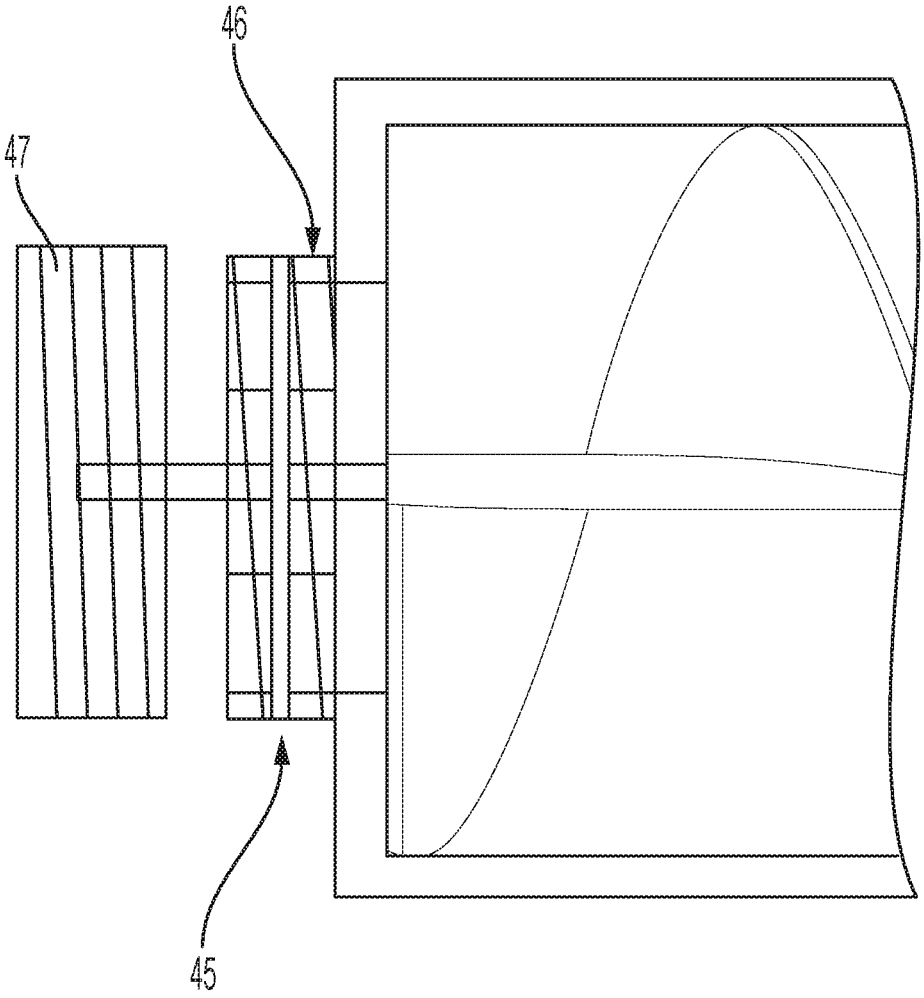
FIG. 8 is a zoomed in side view of the connecting portion or location of the print process material(s) supply container of the print material container, according to an example.

FIG. 8 shows a zoomed in side view of the connecting side 26 of the print material container 20. The print material container 20 may include an outer connector 46. The outer connector 46 may be located on the connecting side 26 of the print material container 20. The imaging forming apparatus 10 may include an image forming apparatus second connector 47. The outer connector 46 is to match with the image forming apparatus second connector 47, as the outer connector 46 is to couple with the image forming apparatus second connector 47 to install the print material container 20 at the second location 32. The print material container 20 may also include an outer connector O-ring 45 to seal the image forming apparatus second connector 47 and the outer connector 46 together. Sealing the image forming apparatus second connector 47 and the outer connector 46 may help prevent print material leakage and help prevent other particles from entering the print material container 20.

As an example, the outer connector 46 includes a component to couple with a second connector 47 at the second location 32 of the image forming apparatus 10. The outer connector 46 may include threads and the image forming apparatus second connector 47 may include embedder threads to mate with threads of the outer connector 46 to couple the outer connector 46 with the image forming apparatus second connector 47. The outer connector 46 and the image forming apparatus second connector 47 may also be coupled to each other using other types of connections such as a slide and lock connection, a cam lock connection, or other types of connections.

The outer connector 46 may be located radially outside of the inner connector 36. Coupling of the print material container 20 to the image forming apparatus 10 at the first location 30 using the inner connector 36 helps keep the outside connector 46 clean from print material and debris when the print material container 20 is removed from the first location 30. Then when the print material container 20 is coupled to the second location 32 using the outer connector 46, having the outside connector 46 clean from print material and debris makes it easier to couple the outer connector 46 and the image forming apparatus second connector 47.

The image forming apparatus 10 may determine the print material container 20 is coupled to a first location 30 of an image forming apparatus 10 to supply print material to the image forming apparatus 10. The image forming apparatus may read information indicating a status of the print material container 20 stored on the memory device or smart chip 28 of the print material container 20. The image forming apparatus 10 may determine, based on the reading, the status of the print material container 20 is to supply print material to the image forming apparatus 10. The image forming apparatus 10 may determine, after the print material container 20 supplies print material to the image forming apparatus 10, an amount of print material in the print material container 20 is below a predetermined threshold. Then, when it is determined the amount of print material in the print material container 20 is below the predetermined threshold, the image forming apparatus 10 may change the status of the print material container 20 on the memory device or smart chip 28 from the status of the print material container is to supply print material to the image forming apparatus to a status of the print material container is to collect or receive at least one of unutilized print material or other matter transferred or received from the image forming apparatus. The image forming apparatus 10 may then display, on a user interface 40, information to remove the print material container 20 from the first location 30.

The image forming apparatus 10 may also determine the print material container 20 is coupled to the second location of the image forming apparatus to collect waster print material. The image forming apparatus 10 may read information indicating the status of the print material container stored on the memory device or smart chip 28 of the print material container 20. The image forming apparatus 10 may determine, based on the reading, the status of the print material container 20 is to collect at least one of unutilized print material or other matter from the image forming apparatus 10. The image forming apparatus 10 may then determine an amount of at least one of unutilized print material or other matter in the print material container 20 is above a predetermined threshold. Then, when it is determined the amount of at least one of unutilized print material or other matter in the print material container 20 is above the predetermined threshold, the image forming apparatus 10 may display, on the user interface 40, instructions to remove the print material container 20 from the second location 32.

The operating method of the image forming apparatus 10 may be embodied in the form of instructions executable by a computer or a processor or a computer-readable storage medium that stores data. The method of operating the image forming apparatus 10 may be written as computer programs and may be implemented in general-use digital computers that execute the programs using a computer readable recording medium. The above-mentioned computer readable recording medium may be read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, a magnetic tape, floppy disc, a magnet optical recording medium, an optical data recording medium, hard disc, solid-state disc (SSD), and any kind of device capable of storing instructions of machine readable instructions, relevant data, data files, and data structure and capable of providing instructions or machine readable instructions, relevant data, data files, and data structures to a processor and a computer such that the processor or computer may execute the instruction.

The foregoing examples are merely examples and are not to be construed as limiting the disclosure. The disclosure can be readily applied to other types of apparatuses. Also, the description of the examples of the disclosure is intended to be illustrative, and not to limit the scope of the claims.

While the disclosure has been described with reference to the accompanying drawings, it is to be understood that the scope of the disclosure is defined by the claims described hereinafter and should not be construed as being limited to the above-described examples and/or drawings. It is to be clearly understood that improvements, changes, and modifications that are obvious to those skilled in the art are also within the scope of the disclosure as defined in the claims.

What is claimed is:

1. A print material container comprising:

a body;

a transfer mechanism to move print material in to or out of the body;

a memory device or smart chip for data;

an inner connector, on a connecting side of the body, to couple to a first location of an image forming apparatus to provide print material to the image forming apparatus; and an outer connector, on the connecting side of the body, to couple to a second location of the image forming apparatus to collect or receive unutilized print material transferred or received from the image forming apparatus, wherein, based on the image forming apparatus determining that the print material in the print material container is below a predetermined threshold, the memory device or smart chip is to receive instructions from the image forming apparatus that the print material container is to collect unutilized print material transferred or received from the image forming apparatus.

2. The print material container of claim 1, wherein the memory device or smart chip includes data or information that indicates to the image forming apparatus or an external data collection entity that the print material container is to provide print material to the image forming apparatus.

3. The print material container of claim 1, wherein the inner connector includes a component to couple with a first connector at the first location of the image forming apparatus.

4. The print material container of claim 3, wherein the outer connector includes a component to couple with a second connector at the second location of the image forming apparatus.

5. The print material container of claim 1, wherein the outer connector is located radially outside of the inner connector.

6. An image forming device, comprising:

a device to produce images or objects on a recording medium; and a print material container coupled to the device, wherein the print material container comprises:

a body;

a transfer mechanism to move print material in to or out of the body;

a memory device or smart chip for data;

an inner connector, on a connecting side of the body, to couple to a first location of the device to provide print material to the device; and an outer connector, on the connecting side of the body, to couple to a second location of the device to collect or receive unutilized print material transferred or received from the device, wherein, based on the image forming apparatus determining that the print material in the print material container is below a predetermined threshold, the memory device or smart chip is to receive instructions from the image forming apparatus that the print material container is to collect unutilized print material transferred or received from the image forming apparatus.

7. The image forming device of claim 6, wherein the memory device or smart chip includes data or information that indicates to the image forming apparatus or an external data collection entity that the print material container is to provide print material to the image forming apparatus.

8. The image forming device of claim 6, wherein the inner connector includes a component to couple with a first connector at the first location of the image forming apparatus.

9. The image forming device of claim 8, wherein the outer connector includes a component to couple with a second connector at the second location of the image forming apparatus.

10. The image forming device of claim 6, wherein the outer connector is located radially outside of the inner connector.

11. A method comprising:

determining a print material container is coupled to a first location of an image forming apparatus to supply print material to the image forming apparatus;

reading information indicating a status of the print material container stored on a memory device or smart chip of the print material container;

determining, based on the reading, the status of the print material container is to supply print material to the image forming apparatus;

determining, after the print material container supplies print material to the image forming apparatus, an amount of print material in the print material container is below a predetermined threshold; and when it is determined the amount of print material in the print material container is below the predetermined threshold, changing the status of the print material container on the memory device or smart chip from the status of the print material container is to supply print material to the image forming apparatus to a status of the print material container is to collect or receive unutilized print material transferred or received from the image forming apparatus; and displaying, on a user interface, information to remove the print material container from the first location.

12. The method of claim 11 further comprising:

determining the print material container is coupled to a second location of the image forming apparatus;

reading information indicating the status of the print material container stored on the memory device or smart chip of the print material container;

determining, based on the reading, the status of the print material container is to collect or receive unutilized print material transferred or received from the image forming apparatus; and determining, after the print material container collects unutilized print material transferred or received from the image forming apparatus, an amount of collected or received unutilized print material in the print material container is above a predetermined threshold.

13. The method of claim 12 further comprising:

when it is determined the amount of collected or received unutilized print material in the print material container is above the predetermined threshold, displaying, on the user interface, information to remove the print material container from the second location.

* * * * *